US009425494B2

(12) United States Patent
Kroening

(10) Patent No.: US 9,425,494 B2
(45) Date of Patent: Aug. 23, 2016

(54) SYSTEMS AND METHODS FOR FERRITE CIRCULATOR PHASE SHIFTERS

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 250 days.

(21) Appl. No.: 14/136,592

(22) Filed: Dec. 20, 2013

(65) Prior Publication Data

US 2015/0180109 A1 Jun. 25, 2015

(51) Int. Cl.

| | |
|---|---|
| ***H01P 1/38*** | (2006.01) |
| ***H01P 1/397*** | (2006.01) |
| ***H01P 1/18*** | (2006.01) |

(52) U.S. Cl.

CPC ..... *H01P 1/397* (2013.01); *H01P 1/181* (2013.01); *H01P 1/38* (2013.01)

(58) Field of Classification Search

CPC ..... H01P 1/18; H01P 1/182; H01P 1/32; H01P 1/38

USPC ..... 333/1.1, 24.2, 156, 157

See application file for complete search history.

(56) References Cited

U.S. PATENT DOCUMENTS

| | | | |
|---|---|---|---|
| 3,185,941 | A | 5/1965 | Freiberg |
| 3,305,797 | A | 2/1967 | Clavin |
| 3,824,502 | A | 7/1974 | Bardash et al. |
| 4,527,134 | A | 7/1985 | Wantuch |
| 6,885,257 | B2 | 4/2005 | Kroening |
| 7,561,003 | B2 | 7/2009 | Kroening |
| 8,427,254 | B2 | 4/2013 | Shinohara et al. |
| 8,957,741 | B2 | 2/2015 | Kroening |

FOREIGN PATENT DOCUMENTS

| | | |
|---|---|---|
| GB | 1211341 | 11/1970 |

OTHER PUBLICATIONS

Kroening, "Combined-Branched-Ferrite Element With Interconnected Resonant Sections for Use in a Multi-Junction Waveguide Circulator", "U.S. Appl. No. 13/906,458, filed May 31, 2013", pp. 1-34, Published in: US.

Billings et al., "Ferrite Circulator Switches and Their Applications", "Microwave Journal", Nov. 2003, pp. 1-2.

Chua, "1 GHz Programmable Analog Phase Shifter for Adaptive Antennas", 1997, pp. 1-79, Published in: CA.

EMS Technologies, "EMS Technologies Application Note 44X-1", Jun. 2002, pp. 1-19.

(Continued)

*Primary Examiner* — Stephen E Jones

(74) *Attorney, Agent, or Firm* — Fogg & Powers LLC

(57) ABSTRACT

Systems and methods for ferrite circulator phase shifters are provided. In one embodiment, a multi-bit phase shifter comprises: a first switching circulator having a first port coupled to a first short circuit of a first phase length; and a second switching circulator coupled in series with the first switching circulator, the second switching circulator having a second port coupled to a second short circuit of a second phase length, the second switching circulator configured to switch in the second short circuit when the first short circuit is switched out by the first switching circulator, and switch out the second short circuit when the first short circuit is switched in by the first switching circulator.

14 Claims, 7 Drawing Sheets

(56) References Cited

OTHER PUBLICATIONS

European Patent Office, "Extended European Search Report from EP Application No. 14194217.7 mailed Jun. 1, 2015", "from Foreign Counterpart of U.S. Appl. No. 14/136,592", Jun. 1, 2015, pp. 6, Published in: EP.

Patton, "Determinants of Electronically Steerable Antenna Arrays", Mar. 1, 1967, pp. 3-37, vol. 28, No. 1, Publisher: RCA Review, Published in: US.

SYSTEMS AND METHODS FOR FERRITE CIRCULATOR PHASE SHIFTERS

BACKGROUND

Ferrite switching circulators can be configured as low loss switched line phase shifters for applications such as beam steering for phased arrays or autotrack modulators for improved beacon tracking in satellite applications. One common problem with switched line phase shifters available today is phase tracking over temperature. That is, the insertion phase of a circulator can change by a few degrees of phase per degree Celsius due to the changes in ferrite material properties over temperature. Thus the effect of temperature on the total phase shift provided by such devices will vary depending on the total number of circulator pass throughs incurred. In one proposed approach to address phase tracking over temperature, two circulators are connected together through two different sections of waveguide with different insertion phase lengths. However, the downside of this approach is that the phase shifter becomes physically large if more than one bit is required. In satellite applications, small size and mass are critical considerations, so a need is present for a switched line phase shifter that has both inherent temperature stability and can be achieved in a compact size.

For the reasons stated above and for other reasons stated below which will become apparent to those skilled in the art upon reading and understanding the specification, there is a need in the art for improved systems and methods for ferrite circulator phase shifters.

SUMMARY

The Embodiments of the present disclosure provide methods and systems for switched circulator pair shifters and will be understood by reading and studying the following specification.

In one embodiment, a multi-bit phase shifter comprises: a first switching circulator having a first port coupled to a first short circuit of a first phase length; and a second switching circulator coupled in series with the first switching circulator, the second switching circulator having a second port coupled to a second short circuit of a second phase length, the second switching circulator configured to switch in the second short circuit when the first short circuit is switched out by the first switching circulator, and switch out the second short circuit when the first short circuit is switched in by the first switching circulator.

DRAWINGS

Embodiments of the present disclosure can be more easily understood and further advantages and uses thereof more readily apparent, when considered in view of the description of the preferred embodiments and the following figures in which.

In accordance with common practice, the various described features are not drawn to scale but are drawn to emphasize features relevant to the present disclosure. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present disclosure. The following detailed description is, therefore, not to be taken in a limiting sense.

Figure 1:
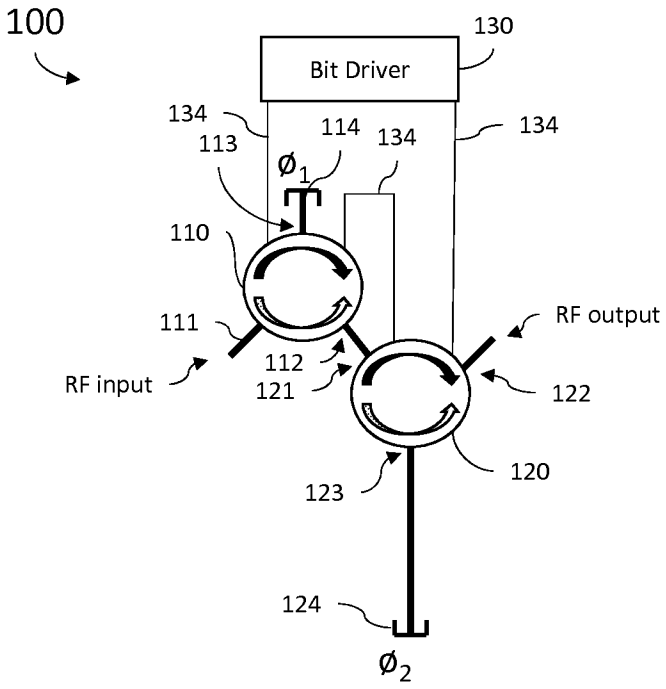
FIG. 1 is a block diagram of a switched circulator pair of one embodiment of the present disclosure.

Embodiments of the present disclosure provide for ferrite circulator phase shifters comprising one or more switched circulator pairs. As the term is used herein, and as illustrated in FIG. 1, a switched circulator pair (shown at 100) comprises a first switching circulator 110 and a second switching circulator 120. Both switching circulators 110, 120 are ferrite circulator waveguides that comprise an input port (111, 121), an output port (112, 122), and a short circuit port (113, 123). Depending on a selected direction of circulation (i.e., clockwise (CW) or counter-clockwise (CCW)), RF energy passes into an input port (111, 121) and flows either to the output port (112, 122) or the short circuit port (113, 123). When the switching circulator is switched to the output port (112, 122), RF energy entering the input port (111, 121) flows through the circulator in a first direction and then out through the output port (112, 122).

When the circulator is switched to the short circuit port (113, 123), RF energy entering the input port (111, 121) flows through the circulator in the opposite direction and out through the short circuit port (113, 123). The RF energy then flows into a short circuit (114, 124) of a set phase length and gets reflected back into the circulator via the short circuit port (113, 123). Upon re-entry into the circulator, the RF energy is directed to the output port (112, 122). As such, it is clear that when a circulator is switched directly to the output port, the RF energy makes a single pass through the circulator. When a circulator is switched to the short circuit port, the RF energy makes two passes through the circulator (once from the input port to the short circuit port, and once from the short-circuit port to the output port). As the terms are used throughout this disclosure, a short circuit is defined to be "switched in" by a circulator when the circulator is switched to the short circuit port for that short circuit and a short circuit is defined to be "switched out" by a circulator when the circulator is switched to the output port and bypasses that short circuit.

The switching circulators 110, 120 are always switched as a pair such that at any one time one, and only one, of the two switching circulators 110, 120 are switched to the short circuit port (113, 123). That is, when the first switching circulator 110 is switched to output port 112, the second switch circulator 120 is switched to short circuit port 123. Conversely, when the first switching circulator 110 is switched to short circuit port 113, the second switch circulator 120 is switched to output port 122.

As shown in FIG. 1, the output port 112 of switching circulator 110 is directed into the input port 121 of switching circulator 120. In this configuration, switched circulator pair 100 operates as a single bit phase shifter. That is, in its base state (which may be referred to as a "reference state" or state "0") RF energy is switched to short circuit port 113 and undergoes a phase shift of $ø_1$ degrees, which is determined by the phase length of short circuit 114. When set to its "switched state" (or state "1") RF energy is switched to flow to short circuit port 123 and undergoes a phase shift of $ø_2$ degrees, which is determined by the phase length of short circuit 124. Note that the "phase lengths" referred to herein refer to the insertion phase, such as measured as S-Parameter S21 on a two port device, and not necessarily a physical length of the short circuits.

For example, in one embodiment, short circuit 114 is configured to provide a phase shift $ø_1$=0° and short circuit 124 is configured to provide a phase shift of $ø_2$=90°. In operation, when the single bit phase shifter is set to state (0), RF energy enters the input port 111, flows into the short circuit 114, gets reflected back into circulator 110, and leaves circulator 110 via output port 112. Then the RF energy enters input port 121 of circulator 120, travels through the circulator and exits via output port 122 (i.e., without circulating to short circuit 124). With the single bit phase shifter is set to state (1), RF energy enters the input port 111, and is directed to output port 112 (i.e., without circulating to short circuit 114). The RF energy enters input port 121 of circulator 120 and flows into the short circuit 124, where it gets reflected back into circulator 120 and then exits via output port 122. Thus for this example, when switched to state 0, switched circulator pair 100 imparts a zero degree phase reference phase shift on the RF energy. When switched to state 1, switched circulator pair 100 imparts a 90 degree phase shift on the RF energy.

Regardless of whether the switched circulator pair 100 is switched to state 0 or state 1, the RF energy flowing through switched circulator pair 100 will always incur three circulator pass-throughs. That is, with embodiments of the present disclosure, each bit comprises two series connected circulators, configured to require the same number of total passes through the two circulator, regardless of the phase setting or "state" of the switched circulator pair. Although this topology does incur the cost of insertion losses due to the number of circulator pass-throughs, this topology also provides the advantage of temperature stability because the effects of temperature on insertion phase will not vary as a function of the switching state. For example if RF energy flowing through switched circulator pair 100 were to incur a 6° insertion phase per degree Celsius due to changes in the ferrite material properties over temperature, that 6° insertion phase component would be the same regardless of which state switched circulator pair 100 is switched to. Further, the relative phase between the two states (e.g. 90 degrees in the example of the previous paragraph) will remain the same as both states' insertion phase change at the same rate.

In one embodiment, switching of circulators 110 and 120 is accomplished by a bit driver 130 coupled to a magnetizing winding 134 which runs through both circulators 110 and 120 in order to establish magnetizing fields in the ferrite elements of the circulators. With the magnetizing winding 134 thread through the circulators 110 and 120, the direction of low-loss propagation through the circulator can be switched back and forth to direct RF energy to either short circuit ports or output ports as described above. A current pulse from bit driver 130 into magnetizing winding 134 of a first polarity will set switched circulator pair 100 to state 0 while a current pulse from bit driver 130 magnetizing winding 134 of an opposite second polarity will set switched circulator pair 100 to state 1. Although FIG. 1 illustrates a single magnetizing winding controlling the state of both circulator 110 and 120, in other embodiments, separate windings can be used with their respective drivers controlled to achieve the same coordinated switching effect. Additional details regarding options and alternatives for circulators 110 and 120 can be found in issued U.S. Pat. Nos. 6,885,257 and 7,561,003 and U.S. patent application Ser. No. 13/906,458, each of which are incorporated herein by reference in their entirety.

Figure 2:
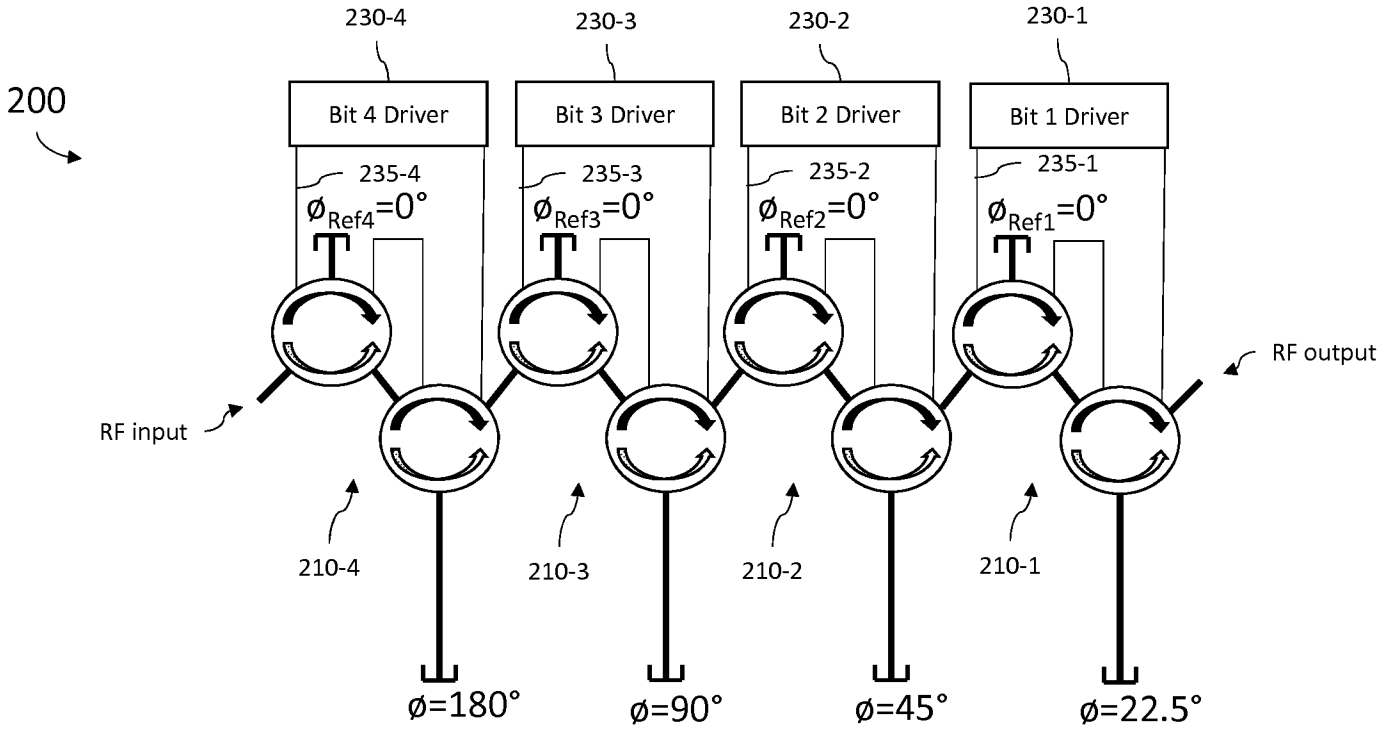
FIG. 2 is a block diagram of a switched circulator pair 4-bit phase shifter of one embodiment of the present disclosure.

As illustrated in FIG. 2, multiple switched circulator pairs (such as pair 100) may be coupled together to form a 4-bit phase shifter 200. In this illustrated embodiment, four switched circulator pairs (shown as 210-1 to 210-4) are combined as shown in FIG. 2 to form the 4-bit phase shifter 200. Each of the switched circulator pairs 210-1 to 210-4 is operated by a corresponding bit driver 230-1 to 230-4 via respective magnetizing windings 235-1 to 235-4.

In this embodiment, the respective short circuits for the reference state of each pair has a phase length configured to provide a reference phase shift (shown as $ø_{Ref1,2,3,4}$=0°. The switched state short circuits for each of the switched circulator pairs 210-1 to 210-4 are configured for respective values such as 180°, 90°, 45°, 22.5° for example. As illustrated in the Table 1 below, the 4-bit phase shifter 200 thus provides for a combination of 16 possible phase shifts. RF energy passes through each of the switched circulator pairs 210-1 to 210-4 three times, for a total of 12 circulator pass-throughs regardless of which of the 16 possible states phase shifter 200 is set to. Relative temperature stability is preserved because the effects of temperature on insertion phase will not vary as a function of which of the 16 switching states is used.

TABLE 1

| 4-Bit Setting | Ø from 210-4 | Ø from 210-3 | Ø from 210-2 | Ø from 210-1 | Cumulative Ø (deg.) |
|---|---|---|---|---|---|
| 0000 | 0 | 0 | 0 | 0 | 0 |
| 0001 | 0 | 0 | 0 | 22.5 | 22.5 |
| 0010 | 0 | 0 | 45 | 0 | 45 |
| 0011 | 0 | 0 | 45 | 22.5 | 67.5 |
| 0100 | 0 | 90 | 0 | 0 | 90 |
| 0101 | 0 | 90 | 0 | 22.5 | 112.5 |
| 0110 | 0 | 90 | 45 | 0 | 135 |
| 0111 | 0 | 90 | 45 | 22.5 | 157.5 |
| 1000 | 180 | 0 | 0 | 0 | 180 |
| 1001 | 180 | 0 | 0 | 22.5 | 202.5 |
| 1010 | 180 | 0 | 45 | 0 | 225 |
| 1011 | 180 | 0 | 45 | 22.5 | 247.5 |
| 1100 | 180 | 90 | 0 | 0 | 270 |
| 1101 | 180 | 90 | 0 | 22.5 | 292.5 |
| 1110 | 180 | 90 | 45 | 0 | 315 |
| 1111 | 180 | 90 | 45 | 22.5 | 337.5 |

Figure 3:
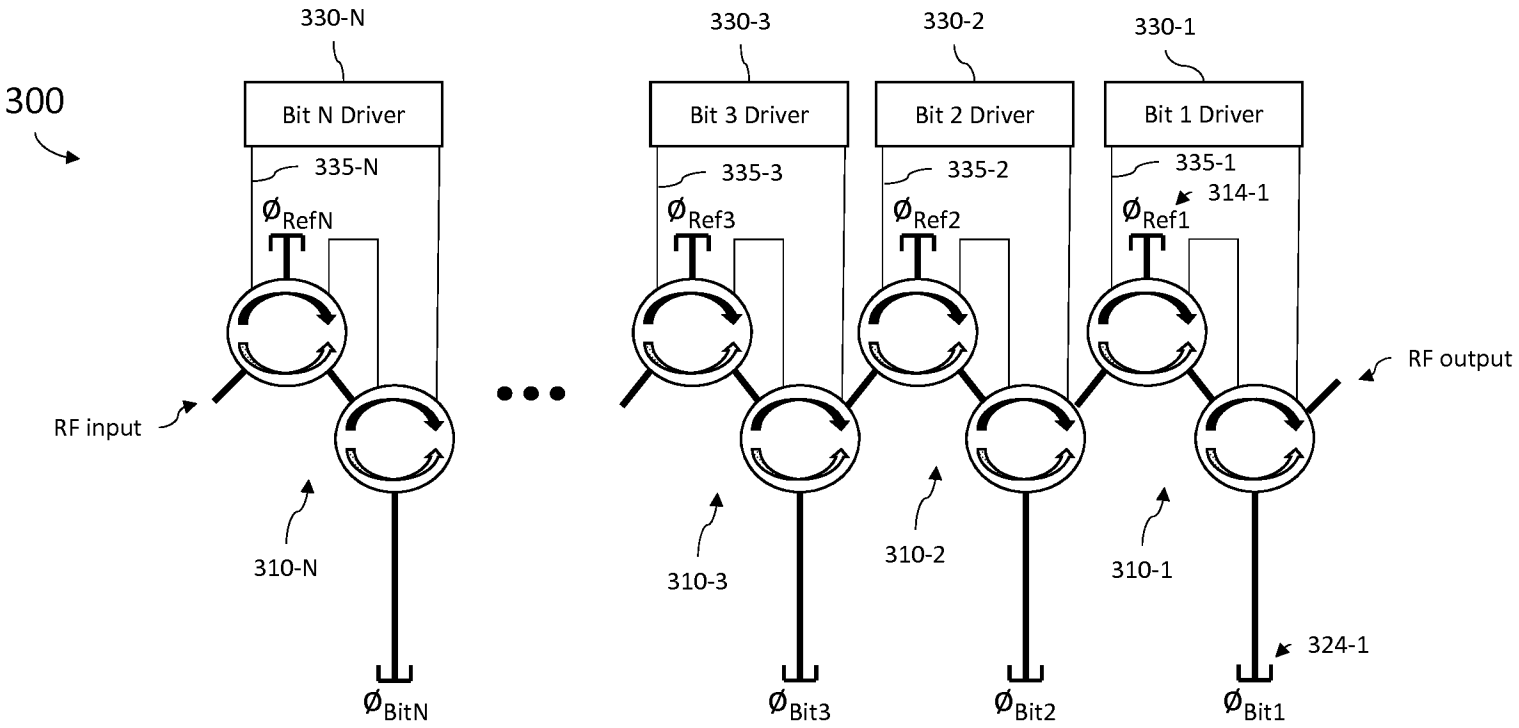
FIG. 3 is a block diagram of a switched circulator pair multi-bit phase shifter of one embodiment of the present disclosure.

FIG. 3 provides another example embodiment of a multi-bit phase shifter 300 of N bits, comprising N switched circulator pairs 310-1 to 310-N each as described with respect to circulator pair 100 above. Each of the switched circulator pairs 310-1 to 310-N is operated by a corresponding bit driver 330-1 to 330-N via respective magnetizing windings 335-1 to 335-N. Note that although the reference state short circuit has been illustrated above as coupled to the first switching circulator of a pair, with the switched state short circuit coupled to the second switching circulator, in alternate embodiments that configuration can be optionally reversed in one or more of the switched circulator pairs 310-1 to 310-N. Also note that the phase lengths described herein for any of the short circuits may be considered relative descriptions, where the difference between the two round trip short circuit lengths within a switched circulator pairs is X° and the actual phase lengths are $ø_{Ref}$=Y° and $ø_{Bit}$=Y°+X°. For example, with respect to switched circulator pair 310-1, in one embodiment, the phase length of short circuit 314-1 may provide $ø_{Ref1}$=45° and the phase length of short circuit 324-1 may provide $ø_{Bit1}$=135°. In that case, switching the state of switched circulator pairs 310-1 would make a relative difference of 90° of phase shift in the output of phase shifter 300.

Figure 4:
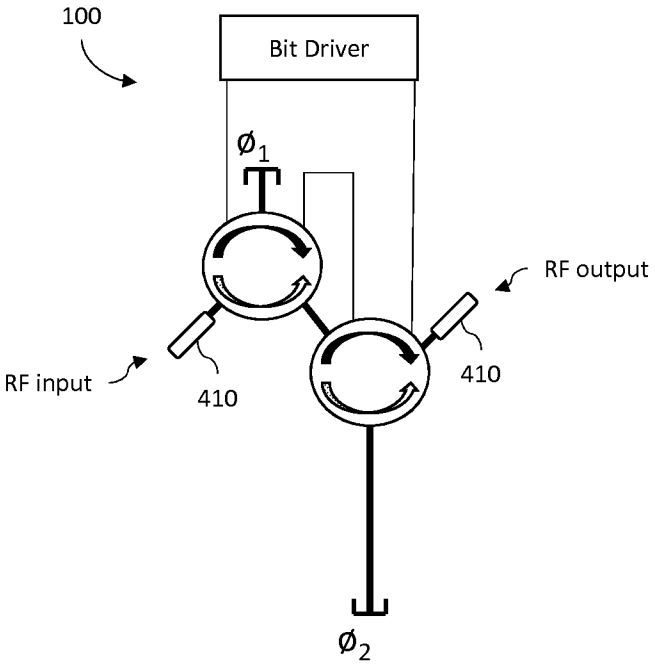
FIG. 4 is a block diagram of a switched circulator pair of one embodiment of the present disclosure.

Possible alternate implementations of any of the embodiments described herein may include the addition of fixed isolators 410 as shown in FIG. 4. When switching into short circuits, the reflections can create standing waves. So, isolators 410 may be desired at the input and output of a multi-bit phase shifter in order to improve the input and output return loss. Isolators may also be included between the phase bits to absorb reflections between the bits. When using the size reduction concepts shown in U.S. Pat. Nos. 6,885,257, 7,561,003, and the pending Ser. No. 13/906,458 US patent application, the size and insertion loss impact of these additional isolators with be minimized.

Figure 5:
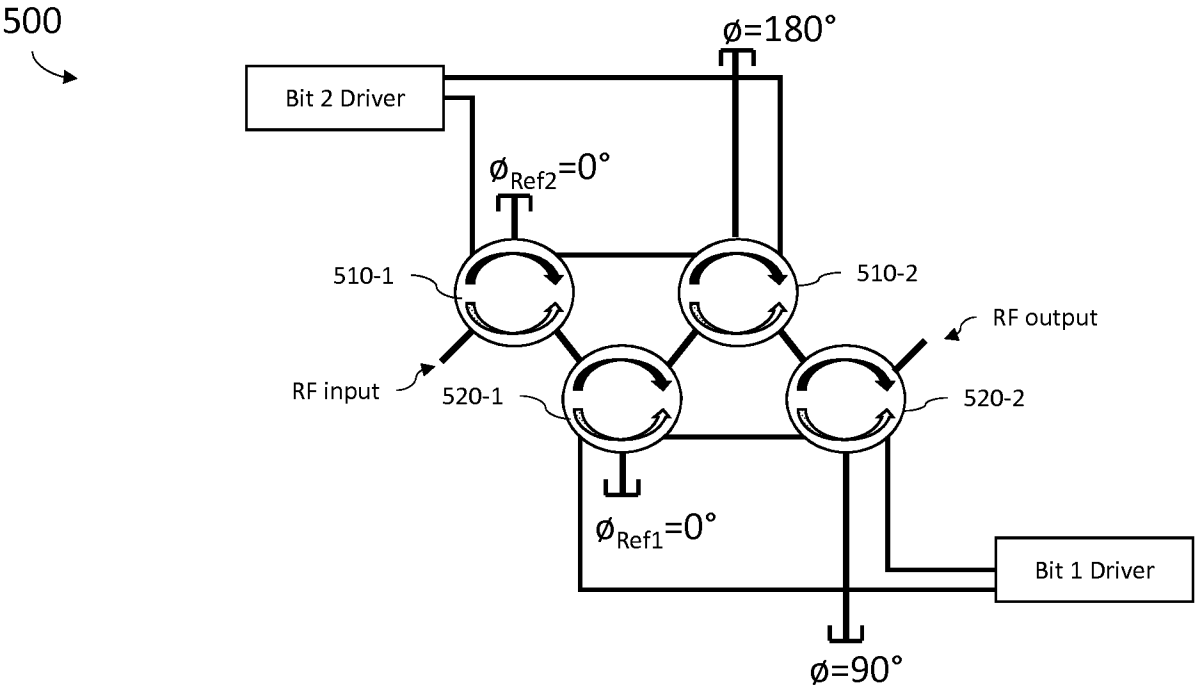
FIG. 5 is a block diagram of a switched circulator pair 2-bit phase shifter of one embodiment of the present disclosure.

Further, as illustrated in FIG. 5, it should be noted that the two switching circulators which comprise a switched circulator pair need not be adjacent to each other in the topology of a multi-bit phase shifter. FIG. 5 illustrates one embodiment of such a multi-bit phase shifter 500. In this embodiment, a first switched circulator pair comprises a first switching circulator 510-1 and a second switching circulator 510-2. The second switch circulator pair similarly comprises a first switching circulator 520-1 and a second switching circulator 520-2. As opposed to the circulator of a given pair being directly coupled in series, they are indirectly coupled by at least one intervening switching circulator. That is, the output of circulator 510-1 is coupled to the input of circulator 520-1, whose output is in turn coupled to the input of circulator 510-2. However, it should be noted that this alternate topology is functionally identical to any of the above embodiments and may be applied to a multi-bit phase shifter having any "n" number of bits. Temperature stability is preserved because the effects of temperature on insertion phase will not vary as a function the switching state. RF energy passes through each of the switched circulator pairs three times, regardless of the state phase shifter is set to.

Figure 6:
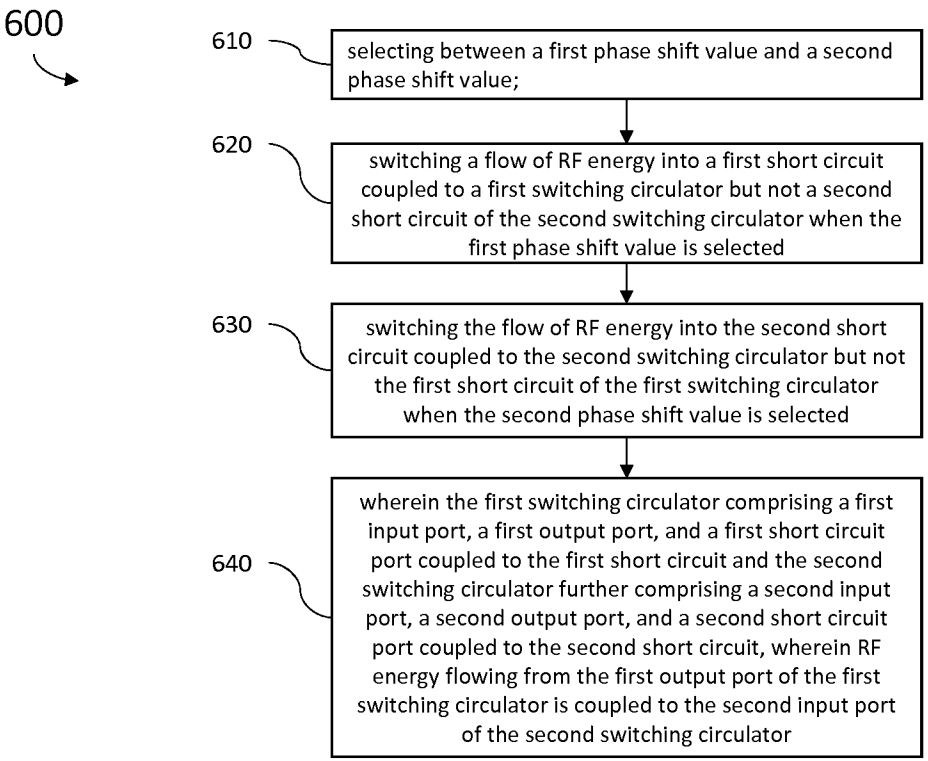
FIG. 6 is a block diagram of method of one embodiment of the present disclosure.

FIG. 6 is a flow chart illustrating a method 600 of one embodiment of the present disclosures which may be implemented in conjunction with any of the device embodiments and their alternates and options described herein. Method 600 begins at 610 with selecting between a first phase shift value and a second phase shift value. The method proceeds to 620 with switching a flow of RF energy into a first short circuit coupled to a first switching circulator but not a second short circuit of the second switching circulator when the first phase shift value is selected. The method proceeds to 630 with switching the flow of RF energy into the second short circuit coupled to the second switching circulator but not the first short circuit of the first switching circulator when the second phase shift value is selected. As indicated at 640, the first switching circulator comprising a first input port, a first output port, and a first short circuit port coupled to the first short circuit and the second switching circulator further comprising a second input port, a second output port, and a second short circuit port coupled to the second short circuit. RF energy flowing from the first output port of the first switching circulator is coupled to the second input port of the second switching circulator. The first and second short circuits will impart a phase change based on their phase length. In one embodiment, either the first or second short circuit may reflect RF energy back with a phase shift of zero degrees. Alternately, in one embodiment, both the first and second short circuit may reflect RF energy back with a phase shift other than zero degrees. Switching the flow of RF energy into the first or second short circuit may be implemented by a bit driver sending a polarized current pulse that runs through the circulators via a magnetizing winding as described above. A pulse of a first polarization will select the first short circuit while a pulse of the opposite polarization will select the second short circuit. In one embodiment, the first switching circulator and the second switching circulator together define a bit of a multi-bit phase shifter. The bit is in a first state when the first short circuit is switched in by the first switching circulator, and the bit is in a second state when the second short circuit is switched in by the second switching circulator. Accordingly, in one implementation, multiple instances of process 600 may be concurrently implemented in order to realize a multi-bit phase shifter. For the reasons described above, RF energy flowing through the first switching circulator and the second switching circulator will make the same total number of circulator pass-throughs regardless of whether the bit is in the first state or the second state.

Figure 7:
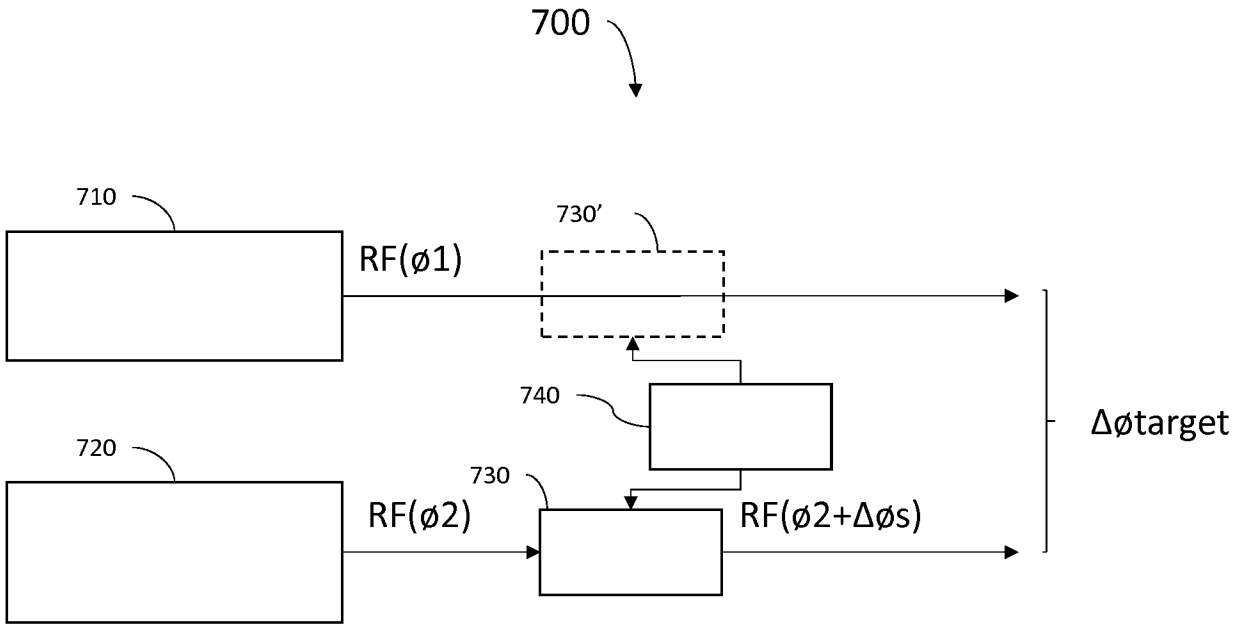
FIG. 7 is a block diagram of system incorporating a switched circulator pair phase shifter of one embodiment of the present disclosure.

It is foreseen that embodiments of the present application may be implemented in many different applications where the relative phase of two RF signals is to be adjusted. For example, FIG. 7 illustrates an example system 700 of one embodiment of the present disclosure. System 700 comprises a first component 710 and a second component 720 that each produce RF signal (shown as RF(ø1) and RF(ø2)). System 700 further comprises at least one multi-bit phase shifter 730 (which may be implemented by any of the phase shifters described with respect to FIG. 1-6) and a phase controller 740 (which may be implemented via one or more bit drivers as described above with respect to FIG. 1-6). As indicated in FIG. 7, a multi-bit phase shifter 730 may be place in-line with the RF output of one of the elements 710 or 720 to modify the relative signal phase angle between the two RF signal to a desired phase angle (indicated by Δøtarget). For example, where it is desired to obtain a maximum summation of the two signals, phase controller 740 can adjust the bit states of multi-bit phase shifter 730 to add a phase shift of Δøs onto RF(ø2) to establish a Δøtarget where the two signals are as closely in-phase as possible. In other applications, such as a modulation scheme for example, it may be desired to phase shift RF(ø2) to be 90 degrees out of phase from RF(ø1) so that they have an in-phase vs. quadrature-phase relationship, for example. In that case phase controller 740 can adjust the bit states of multi-bit phase shifter 730 to add a phase shift of Δøs onto RF(ø2) to establish a Δøtarget where the two signals are 90 degrees out of phase. Then as the output of one or both of the components 710, 720 drift over time, phase controller 740 can further adjust multi-bit phase shifter 730 to maintain the desired relative phase difference between the outputs. In one alternate implementation, an optional second multi-bit phase shifter (shown at 730') may be utilized so that the RF phase angle outputs of both components 710, 720 can be adjusted.

Example Embodiments

Example 1 includes a multi-bit phase shifter comprising a first switching circulator having a first port coupled to a first short circuit of a first phase length; and a second switching circulator coupled in series with the first switching circulator, the second switching circulator having a second port coupled to a second short circuit of a second phase length, the second switching circulator configured to switch in the second short circuit when the first short circuit is switched out by the first switching circulator, and switch out the second short circuit when the first short circuit is switched in by the first switching circulator.

Example 2 includes the phase shifter of example 1, the first switching circulator further comprising a first input port, a first output port, and a first short circuit port coupled to the first short circuit; and the second switching circulator further comprising a second input port, a second output port, and a second short circuit port coupled to the second short circuit, wherein RF energy flowing from the first output port is coupled to the second input port.

Example 3 includes the phase shifter of example 2 wherein RF energy flowing from the first output port is coupled to the second input port through at least one other intervening switching circulator.

Example 4 includes the phase shifter of examples 2 or 3 wherein the first short circuit has a first phase length that reflects RF energy back into the first short circuit port with a reference phase shift.

Example 5 includes the phase shifter of any of examples 2-4 wherein the first short circuit has a first phase length that reflects RF energy back into the first short circuit port with a first phase shift of other than zero degrees; and wherein the second short circuit has a second phase length that reflects RF energy back into the second short circuit port with a second phase shift that is different than the first phase shift.

Example 6 includes the phase shifter of any of examples 2-5 further comprising a bit driver coupled to the first switching circulator and the second switching circulator by at least one magnetizing winding; wherein the bit driver sends a polarized current pulse through the at least one magnetizing winding that runs through the first switching circulator and the second switching circulator.

Example 7 includes the phase shifter of any of examples 2-6 the first switching circulator and the second switching circulator together defining a bit of the multi-bit phase shifter; where the bit is in a first state when the first short circuit is switched in by the first switching circulator, and the bit is in a second state when the second short circuit is switched in by the second switching circulator.

Example 8 includes the phase shifter of any of example 7 wherein RF energy flowing through the first switching circulator and the second switching circulator makes the same total number of circulator pass-throughs regardless of whether the bit is in the first state or the second state.

Example 9 includes a method to phase shift an RF signal, the method comprising: selecting between a first phase shift value and a second phase shift value; switching a flow of RF energy into a first short circuit coupled to a first switching circulator but not a second short circuit of the second switching circulator when the first phase shift value is selected; and switching the flow of RF energy into the second short circuit coupled to the second switching circulator but not the first short circuit of the first switching circulator when the second phase shift value is selected; wherein the first switching circulator comprising a first input port, a first output port, and a first short circuit port coupled to the first short circuit and the second switching circulator further comprising a second input port, a second output port, and a second short circuit port coupled to the second short circuit, wherein RF energy flowing from the first output port of the first switching circulator is coupled to the second input port of the second switching circulator.

Example 10 includes the method of example 9, wherein the first short circuit has a first phase length that reflects RF energy back into the first short circuit port with a reference phase shift.

Example 11 includes the method of examples 9 or 10 wherein the first short circuit has a first phase length that reflects RF energy back into the first short circuit port with a first phase shift of other than zero degrees; and wherein the second short circuit has a second phase length that reflects RF energy back into the second short circuit port with a second phase shift that is different than the first phase shift.

Example 12 includes the method of any of examples 9-11, wherein switching the flow of RF energy into the first short circuit and switching the flow of RF energy into the second short circuit further comprises: sending a polarized current pulse through at least one magnetizing winding that runs through the first switching circulator and the second switching circulator.

Example 13 includes the method of any of examples 9-12, the first switching circulator and the second switching circulator together defining a bit of a multi-bit phase shifter; where the bit is in a first state when the first short circuit is switched in by the first switching circulator, and the bit is in a second state when the second short circuit is switched in by the second switching circulator.

Example 14 includes the method of example 13, wherein RF energy flowing through the first switching circulator and the second switching circulator makes the same total number of circulator pass-throughs regardless of whether the bit is in the first state or the second state.

Example 15 includes a system comprising at least one multi-bit phase shifter, the at least one multi-bit phase shifter comprising: a plurality of switch circulator pairs coupled in series to define an RF energy waveguide path, each of the plurality of switch circulator pairs defining a bit of the multi-bit phase shifter; wherein a first switch circulator pair of the plurality of switch circulator pairs comprises: a first switching circulator having a first port coupled to a first short circuit of a first phase length; and a second switching circulator coupled in series with the first switching circulator, the second switching circulator having a second port coupled to a second short circuit of a second phase length, the second switching circulator configured to switch in the second short circuit when the first short circuit is switched out by the first switching circulator, and switch out the second short circuit when the first short circuit is switched in by the first switching circulator.

Example 16 includes the method of example 15, the at least one multi-bit phase shifter further comprising a second switch circulator pair of the plurality of switch circulator pairs, the second switch circulator pair comprising: a third switching circulator having a third port coupled to a third short circuit of a third phase length; and a fourth switching circulator coupled in series with the third switching circulator, the fourth switching circulator having a fourth port coupled to a fourth short circuit of a fourth phase length, the fourth switching circulator configured to switch in the fourth short circuit when the third short circuit is switched out by the third switching circulator, and switch out the fourth short circuit when the third short circuit is switched in by the third switching circulator; and wherein the first switching circulator, the second switching circulator, the third switching circulator and the fourth switching circulator are coupled together in series.

Example 17 includes the method of examples 15 or 16, wherein the first short circuit has a first phase length that reflects RF energy back into the first port with a reference phase shift.

Example 18 includes the method of any of examples 15-17, wherein the first short circuit has a first phase length that reflects RF energy back into the first port with a first phase shift of other than zero degrees; and wherein the second short circuit has a second phase length that reflects RF energy back into the second port with a phase shift different than the first phase shift.

Example 19 includes the method of any of examples 15-18, further comprising: a first electrical component that outputs a first RF signal; a second electrical component that outputs a second RF signal; and a phase controller; wherein the at least one multi-bit phase shifter modifies a signal phase of the first RF signal relative to a signal phase of the second RF signal based on an output provided by the phase controller.

Example 20 includes the method of example 19, further comprising a bit driver coupled to the first switching circulator and the second switching circulator by at least one magnetizing winding; wherein the bit driver sends a polarized current pulse through the at least one magnetizing winding that runs through the first switching circulator and the second switching circulator; and wherein the bit driver is responsive to the an output provided by the phase controller.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present disclosure. Therefore, it is manifestly intended that this invention be limited only by the claims and the equivalents thereof.

What is claimed is:

1. A multi-bit phase shifter comprising:

a first switching circulator having a first port coupled to a first short circuit of a first phase length; and a second switching circulator coupled in series with the first switching circulator, the second switching circulator having a second port coupled to a second short circuit of a second phase length;

a bit driver coupled to the first switching circulator and the second switching circulator, wherein the bit driver switches the first switching circulator and the second switching circulator as a pair such that the second short circuit is switched in when the first short circuit is switched out, and the first short circuit is switched out when the second short circuit is switched in.

2. The phase shifter of claim 1, the first switching circulator further comprising a first input port, a first output port, and a first short circuit port coupled to the first short circuit;

the second switching circulator further comprising a second input port, a second output port, and a second short circuit port coupled to the second short circuit, wherein RF energy flowing from the first output port is coupled to the second input port.

3. The phase shifter of claim 2, wherein RF energy flowing from the first output port is coupled to the second input port through at least one other intervening switching circulator.

4. The phase shifter of claim 2, wherein the first short circuit has a first phase length that reflects RF energy back into the first short circuit port with a reference phase shift.

5. The phase shifter of claim 2, wherein the first short circuit has a first phase length that reflects RF energy back into the first short circuit port with a first phase shift of other than zero degrees; and wherein the second short circuit has a second phase length that reflects RF energy back into the second short circuit port with a second phase shift that is different than the first phase shift.

6. The phase shifter of claim 1, wherein the bit driver is coupled to the first switching circulator and the second switching circulator by at least one magnetizing winding;

wherein the bit driver sends a polarized current pulse through the at least one magnetizing winding that runs through the first switching circulator and the second switching circulator.

7. The phase shifter of claim 1, the first switching circulator and the second switching circulator together defining a bit of the multi-bit phase shifter; where the bit is in a first state when the first short circuit is switched in by the first switching circulator, and the bit is in a second state when the second short circuit is switched in by the second switching circulator.

8. The phase shifter of claim 7, wherein RF energy flowing through the first switching circulator and the second switching circulator makes the same total number of circulator pass-throughs regardless of whether the bit is in the first state or the second state.

9. A system comprising at least one multi-bit phase shifter, the at least one multi-bit phase shifter comprising:

a plurality of switch circulator pairs coupled in series to define an RF energy waveguide path, each of the plurality of switch circulator pairs defining a bit of the multi-bit phase shifter;

wherein a first switch circulator pair of the plurality of switch circulator pairs comprises:

a first switching circulator having a first port coupled to a first short circuit of a first phase length; and a second switching circulator coupled in series with the first switching circulator, the second switching circulator having a second port coupled to a second short circuit of a second phase length;

a bit driver coupled to the first switching circulator and the second switching circulator, wherein the bit driver switches the first switching circulator and the second switching circulator as a pair such that the second short circuit is switched in when the first short circuit is switched out, and the first short circuit is switched out when the second short circuit is switched in.

10. The system of claim 9, the at least one multi-bit phase shifter further comprising a second switch circulator pair of the plurality of switch circulator pairs, the second switch circulator pair comprising:

a third switching circulator having a third port coupled to a third short circuit of a third phase length; and a fourth switching circulator coupled in series with the third switching circulator, the fourth switching circulator having a fourth port coupled to a fourth short circuit of a fourth phase length, the fourth switching circulator configured to switch in the fourth short circuit when the third short circuit is switched out by the third switching circulator, and switch out the fourth short circuit when the third short circuit is switched in by the third switching circulator; and wherein the first switching circulator, the second switching circulator, the third switching circulator and the fourth switching circulator are coupled together in series.

11. The system of claim 9, wherein the first short circuit has a first phase length that reflects RF energy back into the first port with a reference phase shift.

12. The system of claim 9, wherein the first short circuit has a first phase length that reflects RF energy back into the first port with a first phase shift of other than zero degrees; and wherein the second short circuit has a second phase length that reflects RF energy back into the second port with a phase shift different than the first phase shift.

13. The system of claim 9, further comprising:

a first electrical component that outputs a first RF signal;

a second electrical component that outputs a second RF signal; and a phase controller;

wherein the at least one multi-bit phase shifter modifies a signal phase of the first RF signal relative to a signal phase of the second RF signal based on an output provided by the phase controller.

14. The system of claim 13, wherein the bit driver is coupled to the first switching circulator and the second switching circulator by at least one magnetizing winding;

wherein the bit driver sends a polarized current pulse through the at least one magnetizing winding that runs through the first switching circulator and the second switching circulator; and wherein the bit driver is responsive to the an output provided by the phase controller.

* * * * *